US006392345B1

(12) United States Patent
Niimi et al.

(10) Patent No.: US 6,392,345 B1
(45) Date of Patent: May 21, 2002

(54) HIGH PRESSURE DISCHARGE LAMP HAVING STOPPER ARRANGED BETWEEN TUBULAR MEMBER AND ELECTRODE UNIT

(75) Inventors: Norikazu Niimi, Kasugai; Michio Asai, Nagoya, both of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/272,010

(22) Filed: Mar. 18, 1999

(30) Foreign Application Priority Data

Mar. 30, 1998 (JP) ..... 10-083824

(51) Int. Cl.[7] ..... H01J 17/18; H01J 61/36
(52) U.S. Cl. ..... 313/623; 313/624; 313/626
(58) Field of Search ..... 313/623, 624, 313/625, 626, 568, 574; 445/26, 43

(56) References Cited

U.S. PATENT DOCUMENTS 5,810,635 A * 9/1998 Heider et al. ..... 445/26
6,066,918 A * 5/2000 Suzuki et al. ..... 313/623
6,139,386 A * 10/2000 Suzuki et al. ..... 445/26

FOREIGN PATENT DOCUMENTS

EP 0 573 880 A 12/1993
JP 6-283141 A 10/1994

* cited by examiner

*Primary Examiner*—Nimeshkumar D. Patel
*Assistant Examiner*—Karabi Guharay
(74) *Attorney, Agent, or Firm*—Burr & Brown

(57) ABSTRACT

A high pressure discharge lamp comprises a vessel made of a non-conductive material which forms an inner space filled with an ionizable light-emitting material and a starting gas. The vessel has an opening portion at one end thereof. A tubular member is arranged at the opening portion of the vessel and has an outer diameter which is substantially the same as an inner diameter of the first opening portion. An electrode unit is inserted into the tubular member and has an outer diameter which is smaller than an inner diameter of the tubular member. A stopper is arranged between the tubular member and the electrode unit and has an outer diameter which is substantially the same as the inner diameter of the tubular member. The stopper has a hole into which the electrode unit is inserted. A frit seal is filled in a gap which is formed by the tubular member, the stopper and the electrode unit. The stopper defines an inner end position of the frit seal in the tubular member.

2 Claims, 9 Drawing Sheets

FIG. 1 - Prior Art

HIGH PRESSURE DISCHARGE LAMP HAVING STOPPER ARRANGED BETWEEN TUBULAR MEMBER AND ELECTRODE UNIT

BACKGROUND OF THE INVENTION

1. Field of the Invention

The present invention relates to a high pressure discharge lamp such as a sodium-vapor lamp, metal halide lamp or the like.

2. Background Art

A conventional high pressure discharge lamp is shown in FIG. 1, and includes a vessel 1 made of a non-conductive material (e.g. alumina) which forms an inner space filled with an ionizable light-emitting material and a starting gas. A tubular capillary member 2 is arranged at one opening portion of the vessel, and has an outer diameter which is substantially the same as an inner diameter of the first opening portion. An electrode unit 3 is inserted into the capillary member 2 and has an outer diameter which is smaller than an inner diameter of the capillary member 2.

In such a discharge lamp, a gap formed between the inner surface of the capillary member 2 and the outer surface of the electrode unit 3 is filled with a frit seal 4. However, as shown in FIG. 1, there may occur fluctuation of the axial position of the frit seal 4 in the capillary member 2, as represented by "d" in FIG. 1, so that the axially inner end of the frit seal is not uniformly positioned around the electrode unit. Such fluctuation makes it difficult to maintain a substantially constant volume of the ionizable light-emitting material and the starting gas flowing into the capillary 2, and to realize a uniform property of the discharge lamp. Moreover, when a corrosive material is used as the ionizable light-emitting material, the tendency of the corrosiveness of the electrode unit 3 is notable if the electrode unit 3 is excessively exposed to the discharge space of the vessel 1.

To avoid the above-mentioned fluctuation relating to the non-uniform positioning of the frit seal within the capillary member, it would be necessary to control the volume and the viscosity (i.e. temperature) of the frit seal, though such control is often difficult to perform in a practical manner.

DISCLOSURE OF THE INVENTION

It is an object of the present invention to provide a high pressure discharge lamp in which the axially inner end of the frit seal is uniformly positioned around the electrode unit without the need to control the volume and the viscosity of the frit seal.

According to the present invention, there is provided a high pressure discharge lamp comprising: a vessel made of a non-conductive material which forms an inner space filled with an ionizable light-emitting material and a starting gas, the vessel having an opening portion at one end thereof; a tubular member arranged at the opening portion of the vessel and having an outer diameter which is substantially the same as an inner diameter of the first opening portion; an electrode unit inserted into the tubular member and having an outer diameter which is smaller than an inner diameter of the tubular member; a stopper arranged between the tubular member and the electrode unit and having an outer diameter which is substantially the same as the inner diameter of the tubular member, the stopper having a hole which is inserted by the electrode unit; and a frit seal filled in a gap which is formed by the tubular member, the stopper and the electrode unit, with the stopper defining an inner end position of the frit seal in the tubular member.

According to the invention, a frit seal is filled in a gap which is formed by the tubular member, the stopper and the electrode unit, with the stopper defining an inner end position of the frit seal in the tubular member. The axially inner end of the frit seal can be uniformly positioned around the electrode unit by the stopper without the control of the temperature of the frit seal.

Preferably, the stopper comprises a porous non-conductive member.

Composing the stopper of a porous non-conductive member eliminates the need to control the volume of the frit seal. The axially inner end of the frit seal can be uniformly positioned around the electrode unit because excess frit seal is absorbed by the porous non-conductive member. In this connection, the porous material which can be suitable used in the present invention has a number of pores with an average pore diameter of approximately 1 to 10 $\mu$m and a porosity of not less than approximately 30%.

DESCRIPTION OF THE PREFERRED EMBODIMENTS

Figure 1:
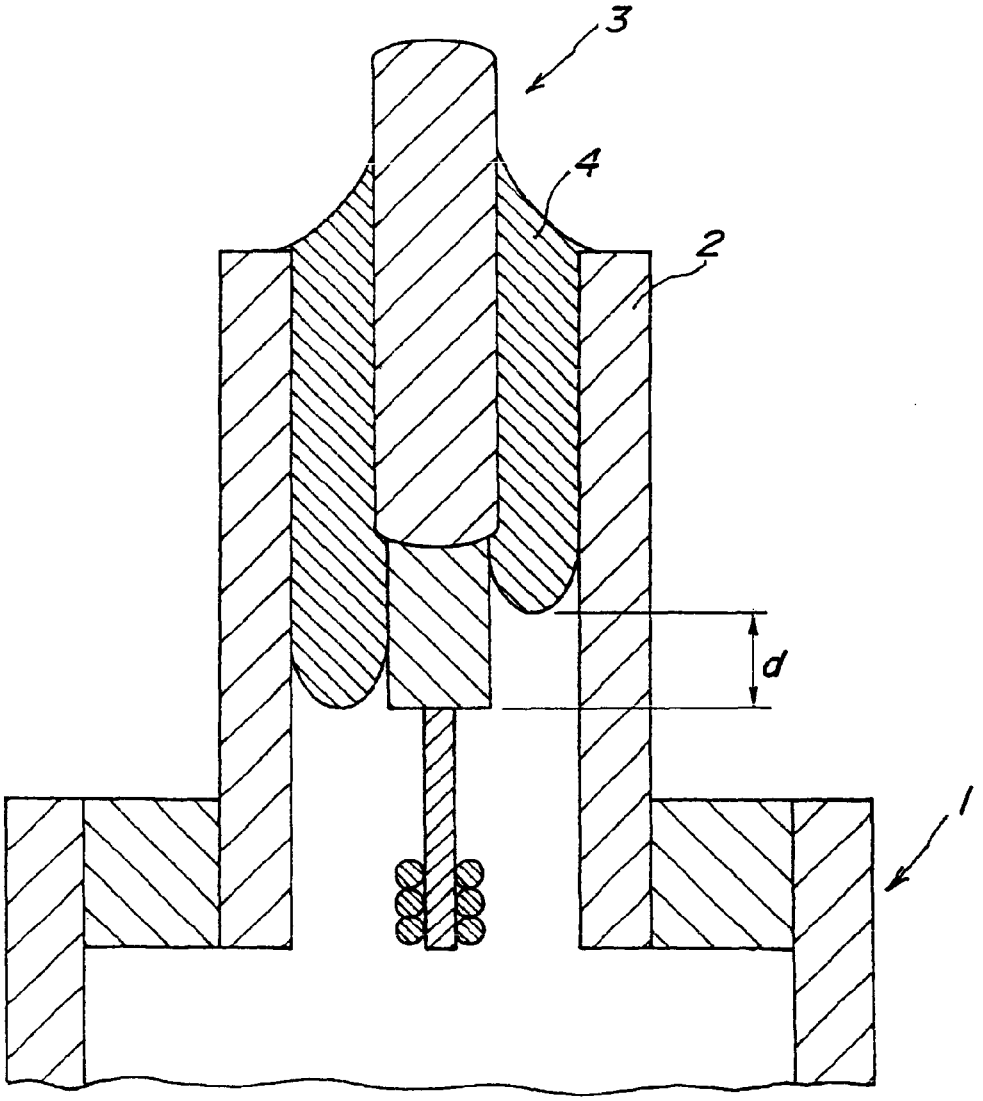
FIG. 1 is a sectional view showing one end portion of the vessel in a conventional high pressure discharge lamp.

One embodiment of the high pressure discharge lamp according to the present invention will be explained below with reference to the accompanying drawings, wherein the same reference numerals denote the same or corresponding elements.

Figure 2:
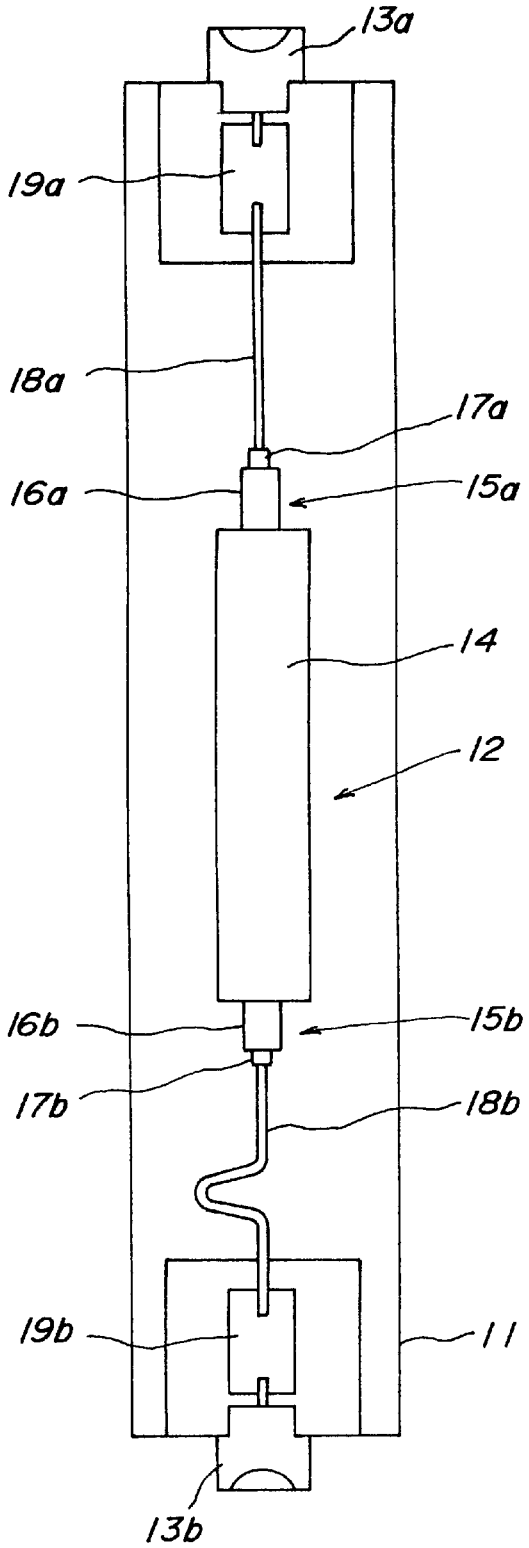
FIG. 2 is a schematic view showing one embodiment of the high pressure discharge lamp according to the present invention.

FIG. 2 shows the structure of the high pressure discharge lamp as a whole, which is in accordance with the present invention. The high pressure lamp includes an outer tube 11 made of quartz glass or hard glass, and a ceramic discharge tube 12 is placed in the outer tube 11 coaxially thereto.

Both ends of the outer tube 11 are tightly sealed with respective caps 13*a*, 13*b*. The ceramic discharge tube 12 comprises a tubular vessel 14 made of alumina and tubular members in the form of capillary members 16*a*, 16*b* made of alumina are provided at both ends 15*a*, 15*b* of the tubular vessel 14, respectively, and electrode units 17*a*, 17*b* inserted into the capillary members 16*a*, 16*b*, respectively.

The ceramic discharge tube 12 is held by the outer tube 11 via two lead wires 18*a*, 18*b*. The lead wires 18*a*, 18*b* are connected to the respective caps 13*a*, 13*b* via respective foils 19*a*, 19*b*.

Figure 3:
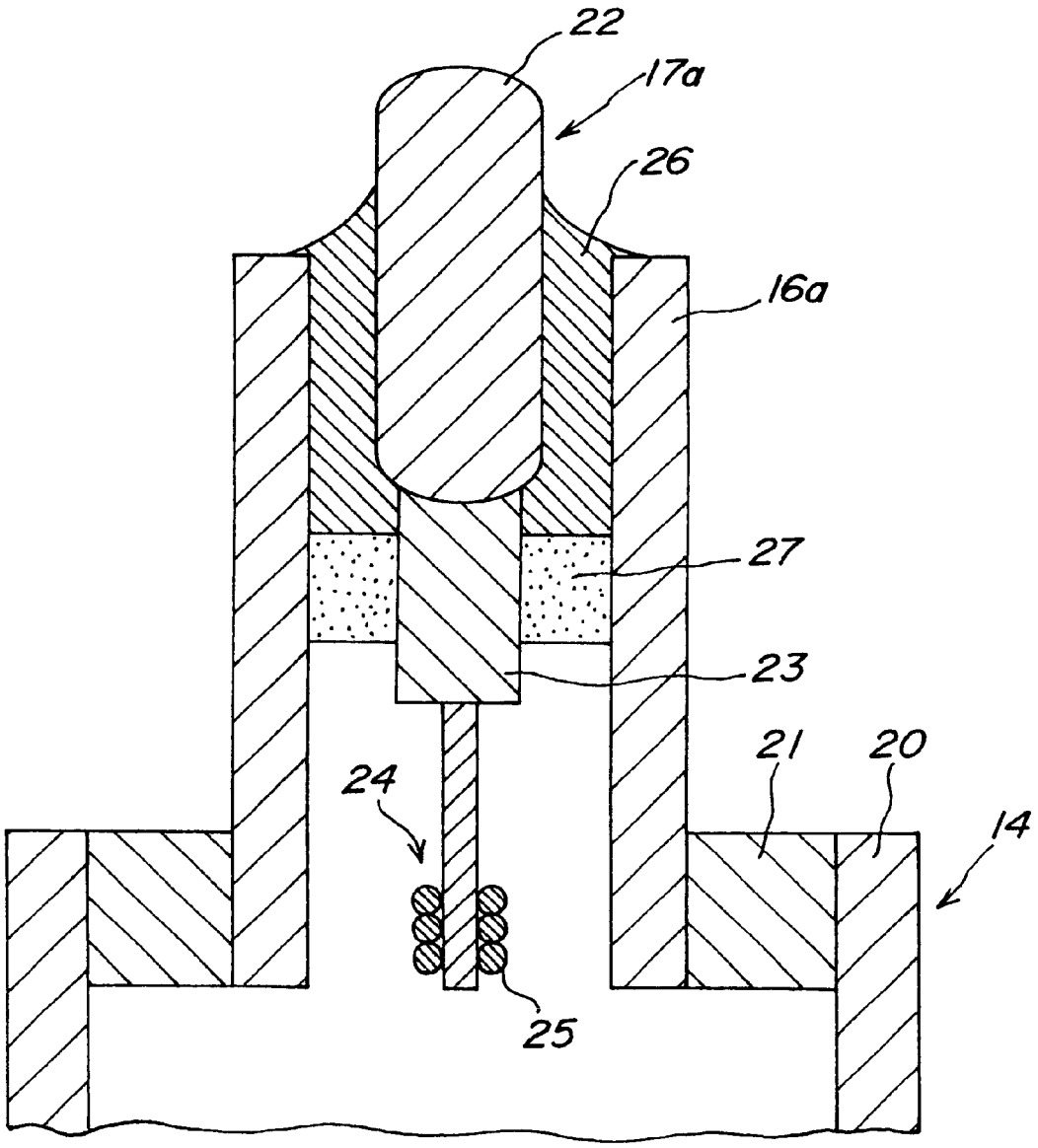
FIGS. 3 to 8 are sectional views showing various examples of the end portion of the vessel in the embodiment shown in FIG. 2.

FIG. 3 is a sectional view showing a first example of the end portion of the vessel in the embodiment shown in FIG. 2. As shown in FIG. 3, a vessel 14 has a tubular body 20 and a disc 21. The electrode unit 17*a* comprises a cylindrical member 22 made of niobium, a cylindrical member 23 made of cermet of molybdenum and conductive material which is jointed at the bottom of the cylindrical member 22 without being exposed to outside of the vessel 14, and an electrode 24 which is jointed at the bottom of the cylindrical member 23 exposed to the inner space of the vessel 14. The electrode 24 is provided with a coil 25 in a conventional manner.

A stopper 27 inserted by the electrode unit defines an inner end position of a frit seal 26 in the tubular member 16*a*. In this case, the stopper 27 comprises a porous member having a number of pores with an average pore diameter of approximately 1 to 10 $\mu$m and a porosity of not less than approximately 30%. A gap formed between an inner surface of the capillary member 16*a*, an upper end of the stopper 27 and an outer surface of the electrode unit 22 is filled with the frit seal 26.

According to the embodiment, the axially inner end of the frit seal 26 is uniformly positioned around the electrode unit 17*a* without requiring a control of the temperature of the frit seal 26. Further, by composing the stopper 27 of a porous member, any excess frit seal is absorbed by the porous member in the event that excess frit seal 26 is supplied to the gap. Therefore, the axially inner end of the frit seal 26 is uniformly positioned around the electrode unit 17*a* without having to control the volume of the frit seal 26. Due to uniform axial position of the frit seal in the capillary member 16*a*, the property of the discharge lamp is prevented from undesirable fluctuation. Moreover, even when a material having a corrosiveness is used as an ionizable light-emitting material, the corrosiveness of the electrode unit 17*a* does not proceed.

Figure 4:
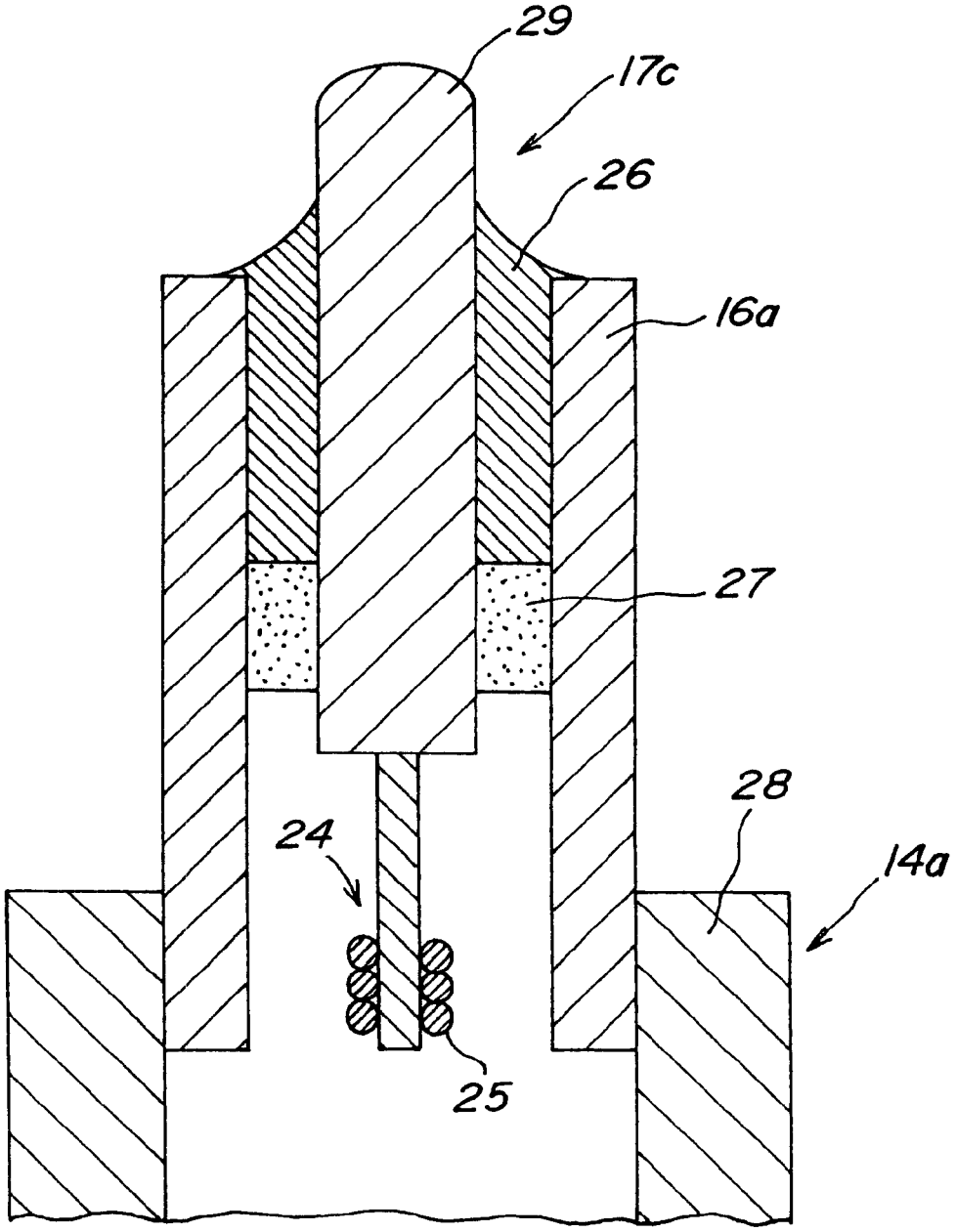

FIG. 4 is a sectional view showing a second example of the end portion of the vessel shown in FIG. 2. As shown in FIG. 4, the vessel 14*a* only has a cylindrical main body 28 (i.e., disc 21 is absent). An electrode unit 17*c* has a cylindrical member 29 made of molybdenum, and an electrode 24 jointed at the end of the cylindrical member 29 exposed to the inner space of the vessel 14*a*.

Figure 5:
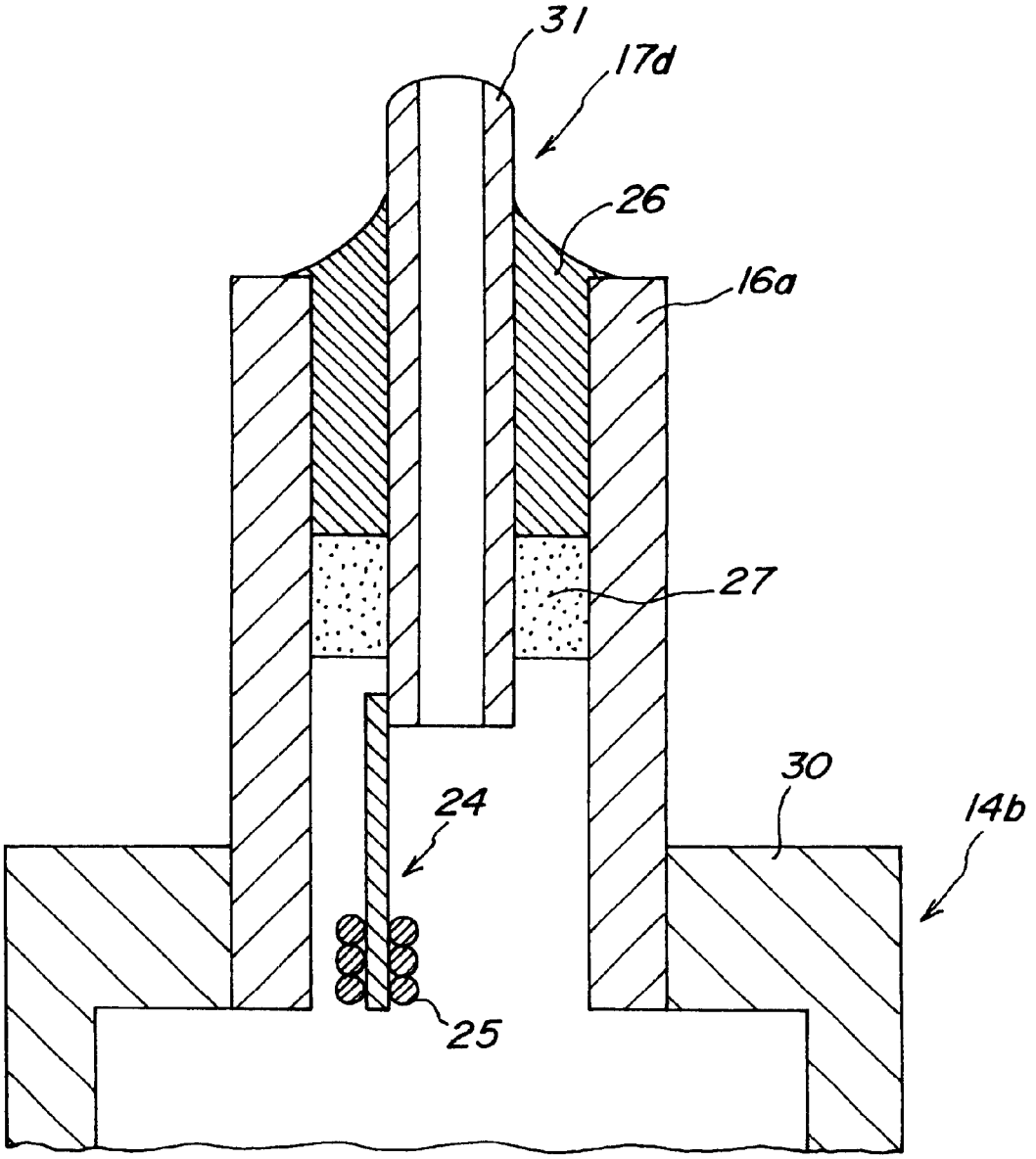

FIG. 5 is a sectional view showing a third example of the end portion of the vessel shown in FIG. 2. As shown in FIG. 5, a vessel 14*b* comprises a cylindrical main body 30 having an annular collar which forms an inner space of the vessel and defines opening portions at both ends thereof. An electrode unit 17*d* has a tubular holding member 31 for the electrode unit, and the electrode 24 is tightly jointed by welding at the end of the unit-holding member 31 and is exposed to the inner space of the vessel 14*b*. After an ionizable light-emitting material has been charged into the inner space of the vessel 14*b* through the electrode unit-holding member 31, the end of the holding member 31 is sealed by laser welding or TIG welding.

Figure 6:
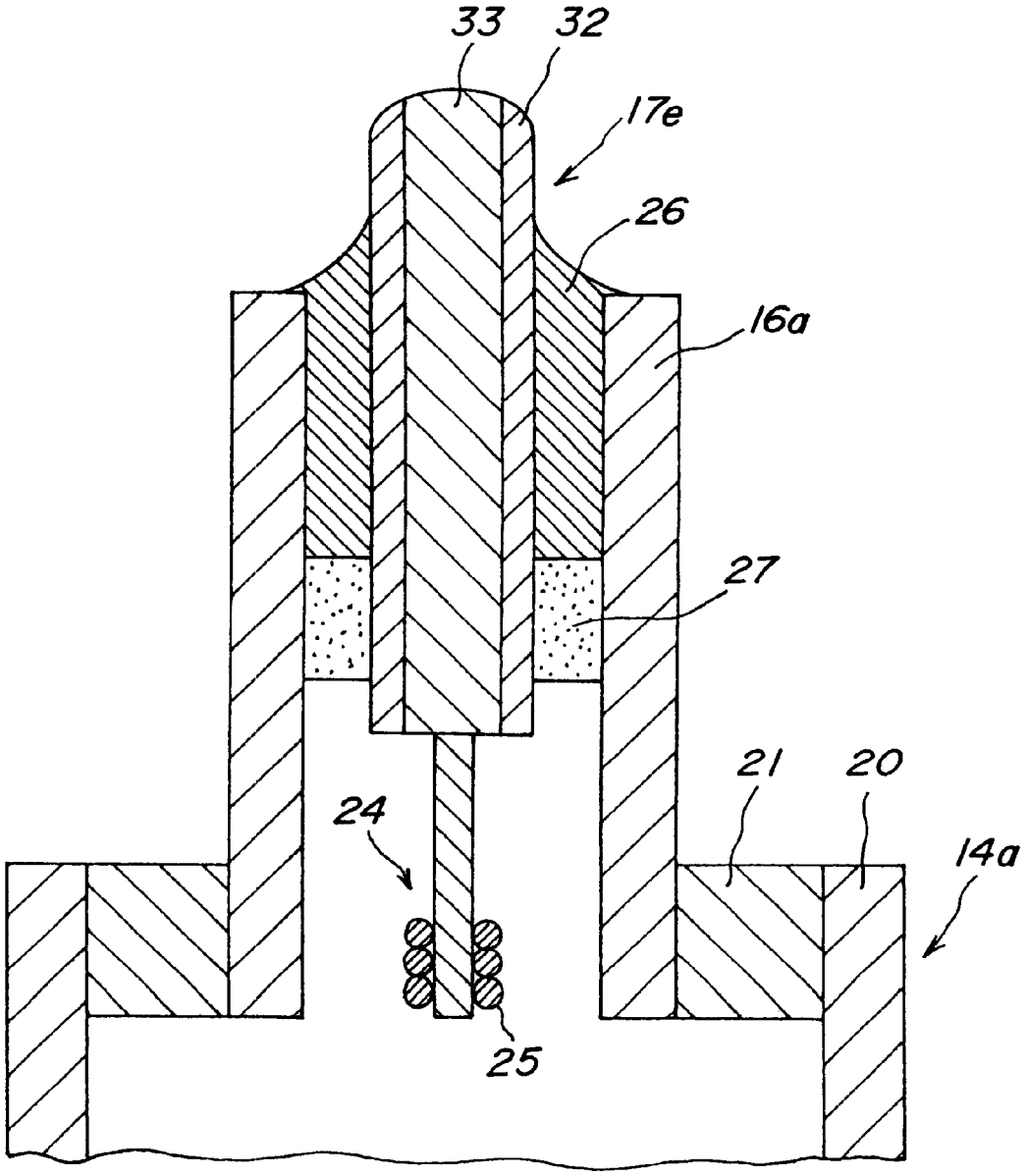

FIG. 6 is a sectional view showing a fourth example of the end portion of the vessel shown in FIG. 2. As shown in FIG. 6, and electrode unit 17*e* has an electrode unit-holding member 33 of which an electrode 24 is jointed at the bottom by welding. The electrode unit-holding member 33 is inserted into a tubular member 32 so that the electrode 24 is exposed to the inner space of the vessel 14*a*.

Figure 7:
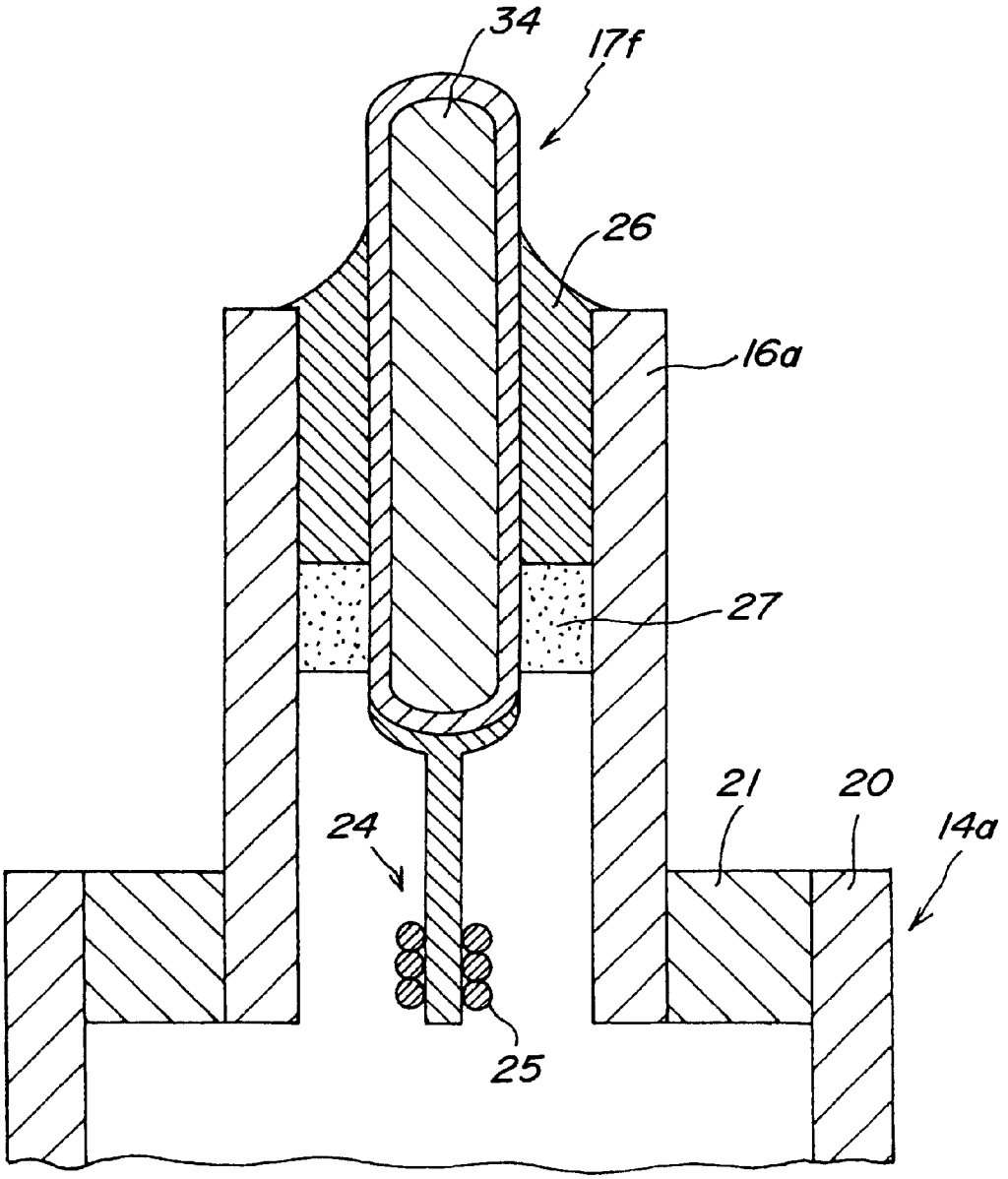

FIG. 7 is a sectional view showing a fifth example of the end portion of the vessel shown in FIG. 2. As shown in FIG. 7, an electrode member 17*f* has a substantially cylindrical member 34 which has a cylindrical member made of non-conductive material (e.g. alumina) coated with a mixture of a metal (e.g. molybdenum) and a non-conductive material (e.g. alumina), and the electrode 24 jointed at the bottom of the substantially cylindrical member 34 exposed to the inner space of the vessel 14*a*.

Figure 8:
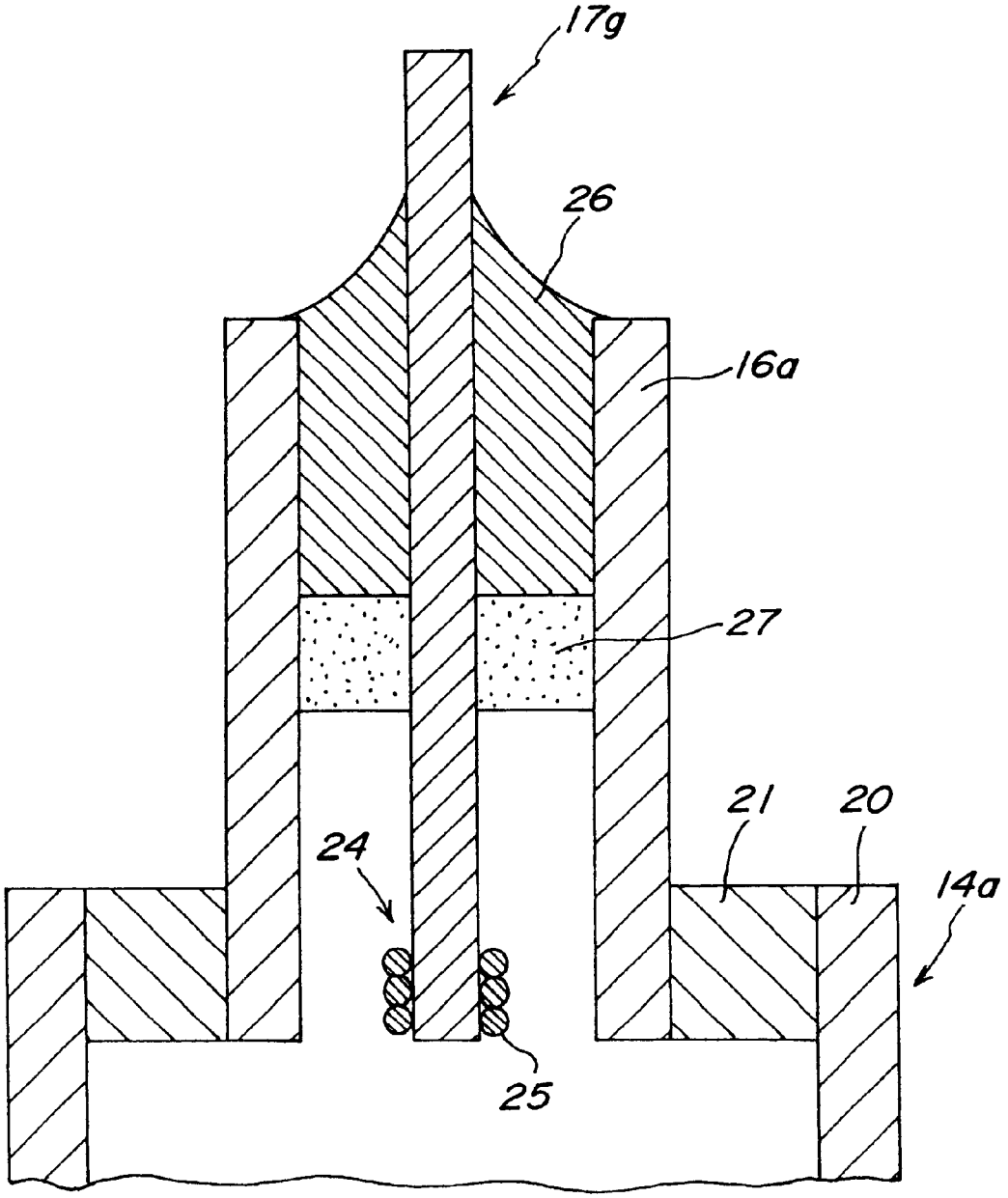

FIG. 8 is a sectional view showing a sixth example of the end portion of the vessel shown in FIG. 2. As shown in FIG. 8, an electrode 17*g* may be constituted of a single electrode 24.

The method of manufacturing the high pressure discharge lamp according to the above-mentioned embodiment will be described below.

Figure 9:
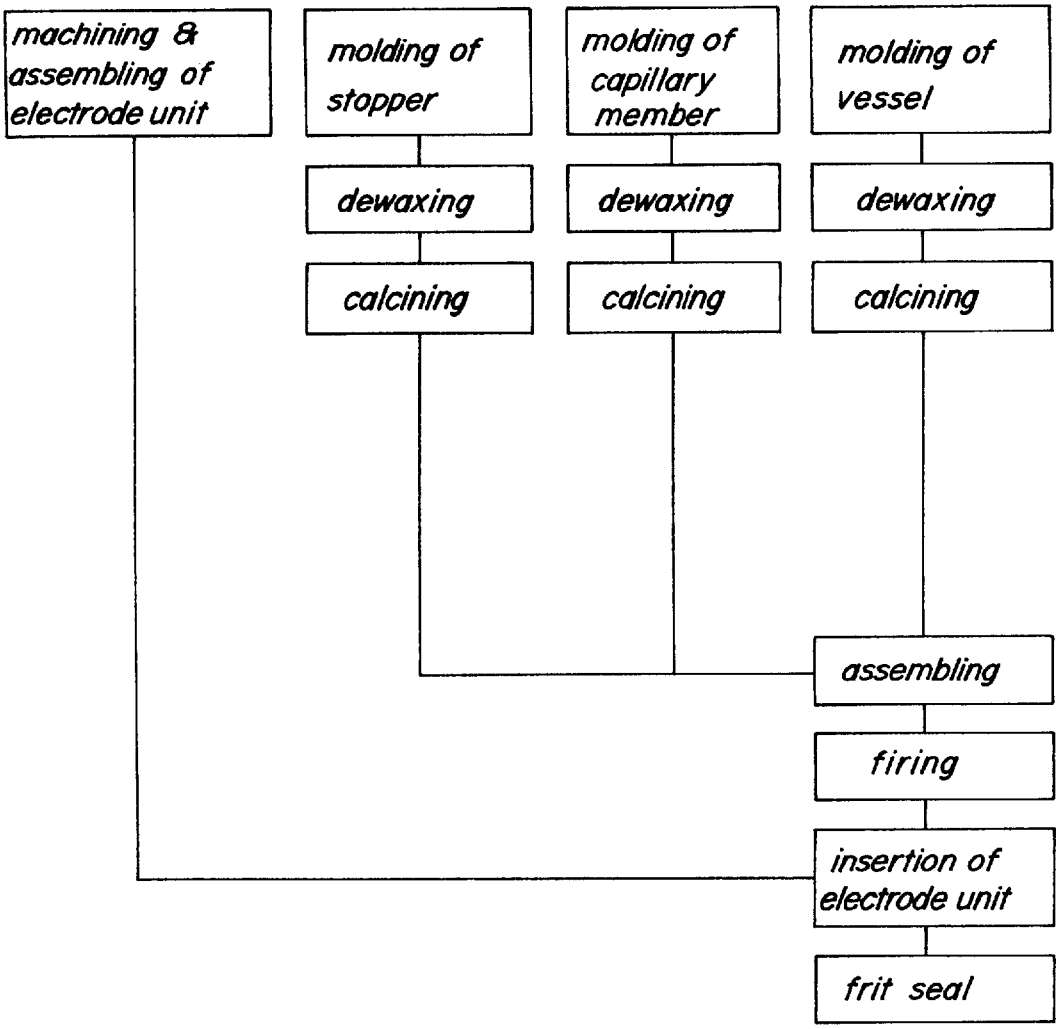
FIG. 9 is flow chart illustrating the process steps for manufacturing the high pressure discharge lamp according to the present invention.

FIG. 9 is a flowchart illustrating the process steps for manufacturing the high pressure discharge lamp according to the present invention. In this process, first of all, alumina or cermet powder granulated by a spray drier or the like is press-molded under a pressure of 2000 to 3000 kgf/cm$^2$ to obtain a molded body for the capillary member. At this stage, alumina or cermet powder granulated by a spray drier or the like is press-molded under a pressure of 0.6 to 0.8 times of the pressure when the molded body for the capillary member is manufactured to obtain a molded body for the stopper constituted by a porous member. Preferably, these molded bodies formed as such are dewaxed by heating at a temperature of 600 to 800° C., and calcined by heating at a temperature of 1200 to 1400° C. in a hydrogen-reduced atmosphere, respectively. By this calcining, a strength is more or less given to the molded bodies to facilitate handling of the capillary member and the stopper.

Also, the composite electrode is processed and assembled in parallel with the molding, dewaxing and calcining of the capillary member and the stopper. Moreover, the vessel of the ceramic discharge tube is molded, and the calcined body for the ceramic discharge tube is obtained by dewaxing and calcining the molded body. The calcined body for the capillary member is inserted and set into the end face of the calcined body for the ceramic discharge tube, and the calcined body for the stopper is then inserted and set into the calcined body for the capillary body at a position to be filled with the frit seal by a conductive rod, and the assembly is subjected to finish-firing at a temperature of 1600 to 1900° C. in a reducing atmosphere having a dew point of −15 to 15° C. Then, the electrode unit is subsequently inserted into the capillary member, so a gap is formed by the inner end of the capillary, the upper end of the stopper and the inner surface of the electrode unit, and filled with the frit seal to obtain the high pressure discharge lamp of the present invention.

While the present invention has been described above with reference to certain preferred embodiments, it should be noted that they were presented by way of examples only and various changes and/or modifications may be made without departing from the scope of the invention. For example, a non-conductive material other than alumina (e.g. cermet) may be used as a material of the vessel and the capillary. Also, the vessel and the capillary member are formed by a same material, however the material forming the vessel may be different from that forming the capillary (For example, the vessel is made of alumina and the capillary is made of cermet.).

The vessel may take any other form than the tubular form or the barrel form. The electrode does not have to have the coil. In FIG. 3, the cylindrical member 23 is composed of cermet of molybdenum and conductive material, however it may be composed of cermet of tungsten and conductive material.

Moreover, in manufacturing the discharge lamp of the present invention, after co-firing the vessel, the capillary member and the stopper into an integrated body, the electrode unit is inserted into the capillary member, however, the vessel, the capillary member and the electrode unit-holding member may be assembled after the stopper is inserted into the electrode unit to be co-fired into an integrated body.

What is claimed is:

1. A high pressure discharge lamp comprising:

a vessel made of a non-conductive material which forms an inner space filled with an ionizable light-emitting material and a starting gas, said vessel having an opening portion at one end thereof;

a tubular member arranged at said opening portion of the vessel and having an outer diameter which is substantially the same as an inner diameter of said opening portion;

an electrode unit inserted into said tubular member and having an outer diameter which is smaller than an inner diameter of said tubular member;

a stopper arranged between said tubular member and said electrode unit and having an outer diameter which is substantially the same as said inner diameter of said tubular member, said stopper having a hole through which said electrode unit is inserted, said hole of the stopper being defined by an inner surface that contacts said electrode unit directly; and a frit seal filled in a gap which is formed by said tubular member, said stopper and said electrode unit, with said stopper defining an inner end position of said frit seal in said tubular member.

2. A high pressure discharge lamp comprising:

a vessel made of a non-conductive material which forms an inner space filled with an ionizable light-emitting material and a starting gas, said vessel having an opening portion at one end thereof;

a tubular member arranged at said opening portion of the vessel and having an outer diameter which is substantially the same as an inner diameter of said opening portion;

an electrode unit inserted into said tubular member and having an outer diameter which is smaller than an inner diameter of said tubular member;

a porous non-conductive stopper arranged between said tubular member and said electrode unit, said stopper having an outer diameter which is substantially the same as said inner diameter of said tubular member, said stopper having a hole through which said electrode unit is inserted; and a frit seal filled in a gap which is formed by said tubular member, said stopper and said electrode unit, with said stopper defining an inner end position of said frit seal in said tubular member.

* * * * *